US008453391B2

(12) United States Patent
Tabibnia

(10) Patent No.: US 8,453,391 B2
(45) Date of Patent: Jun. 4, 2013

(54) APPARATUS FOR ESTABLISHING A PAVER OVER A SUBSURFACE

(76) Inventor: Ramin Tabibnia, Los Angeles, CA (US)

( * ) Notice: Subject to any disclaimer, the term of this patent is extended or adjusted under 35 U.S.C. 154(b) by 385 days.

(21) Appl. No.: 12/732,755

(22) Filed: Mar. 26, 2010

(65) Prior Publication Data

US 2011/0232208 A1 Sep. 29, 2011

(51) Int. Cl.
*E04F 15/024* (2006.01)
*E04B 5/43* (2006.01)

(52) U.S. Cl.
USPC ..... 52/126.6; 52/98; 52/100; 52/263; 248/188.2; 248/346.05

(58) Field of Classification Search
USPC ..... 52/126.1, 126.5, 126.6, 263, 98, 52/100; 248/188.2, 188.5, 188.8, 346.01, 248/346.05; 404/26
See application file for complete search history.

(56) References Cited

U.S. PATENT DOCUMENTS

| | | | | | |
|---|---|---|---|---|---|
| 133,766 | A * | 12/1872 | Easterly | 248/188.2 |
| 1,402,998 | A * | 1/1922 | Anderson | 248/188.2 |
| 1,639,495 | A * | 8/1927 | Frame | 404/26 |
| 3,689,017 | A * | 9/1972 | Harvey | 248/354.3 |
| 3,861,098 | A * | 1/1975 | Schaub | 52/98 |
| 4,570,397 | A * | 2/1986 | Creske | 52/126.6 |
| 5,074,085 | A * | 12/1991 | Ueda | 52/126.6 |
| 5,205,668 | A * | 4/1993 | Adams | 404/26 |
| 5,442,882 | A * | 8/1995 | Repasky | 52/105 |
| 5,564,855 | A * | 10/1996 | Anderson | 404/26 |
| 5,588,264 | A * | 12/1996 | Buzon | 52/126.6 |
| 5,956,905 | A * | 9/1999 | Wiedrich | 52/20 |
| 6,152,409 | A * | 11/2000 | Schrepfer | 248/188.2 |
| 6,161,984 | A * | 12/2000 | Sinclair | 404/25 |
| 6,332,292 | B1 * | 12/2001 | Buzon | 52/126.6 |
| 6,363,685 | B1 * | 4/2002 | Kugler | 52/745.05 |
| 6,520,471 | B2 * | 2/2003 | Jones et al. | 248/346.5 |
| 6,520,713 | B2 * | 2/2003 | Sondrup | 404/26 |
| 6,524,026 | B2 * | 2/2003 | Sondrup | 404/26 |
| 6,604,330 | B2 * | 8/2003 | Repasky | 52/263 |
| 6,682,258 | B2 * | 1/2004 | McNeely | 404/26 |
| 6,799,920 | B2 * | 10/2004 | Sondrup | 404/26 |
| 6,955,499 | B2 * | 10/2005 | Sondrup | 404/26 |
| 7,386,955 | B1 * | 6/2008 | Repasky | 52/126.6 |
| 7,527,229 | B2 * | 5/2009 | Dabrowski | 248/188.2 |
| 7,866,096 | B2 * | 1/2011 | Lee et al. | 52/126.6 |
| 7,918,059 | B2 * | 4/2011 | Repasky | 52/263 |
| 7,921,612 | B2 * | 4/2011 | Knight et al. | 52/126.6 |
| 2002/0148173 | A1 * | 10/2002 | Kugler | 52/126.6 |
| 2003/0070372 | A1 * | 4/2003 | Favero | 52/220.1 |
| 2004/0035064 | A1 * | 2/2004 | Kugler et al. | 52/126.6 |
| 2004/0261329 | A1 * | 12/2004 | Kugler et al. | 52/126.6 |
| 2010/0058679 | A1 * | 3/2010 | Greaves | 52/126.6 |
| 2011/0016809 | A1 * | 1/2011 | Knight et al. | 52/263 |
| 2012/0168592 | A1 * | 7/2012 | Jones | 248/346.5 |

* cited by examiner

*Primary Examiner* — Robert Canfield
(74) *Attorney, Agent, or Firm* — John K. Buche; Buche & Associates, P.C.

(57) ABSTRACT

Disclosed is an improved component for apparatus for facilitating the elevated and leveled placement of a paver surface. Also disclosed are apparatus composed of the disclosed component. Yet further disclosed are related methods of use for the component and the apparatus composed of the same.

10 Claims, 13 Drawing Sheets

APPARATUS FOR ESTABLISHING A PAVER OVER A SUBSURFACE

CROSS-REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of Invention

The present application is in the field of methods and apparatus for establishing a paver surface. The present application is also in the field of methods and apparatus for elevating a paver surface with respect to a subsurface and/or compensating for the slope of the subsurface.

2. Background of the Invention

Frequently, it is desirable to establish a surface above a subsurface. For instance, a surface may be established over a subsurface to, in effect, adjust the aesthetic and/or physical properties of the subsurface. Commonly, such a surface is established via placing an array of pavers onto the subsurface. "Pavers" are, for example, items for covering a subsurface and may include, without being limited to, tiles, stones, bricks, molded concrete, and/or the like. Therefore, there is a need for an apparatus and related methods which facilitate the placement of a paver array onto a subsurface.

The aesthetic appearance of a paver surface can depend on the spacing, shape, and orientation of the component pavers. Notably, a surface comprising a tessellated array of pavers will typically be more aesthetically pleasing when the component pavers are evenly and uniformly spaced and oriented. For this reason, there is a need for an apparatus and related methods which facilitate the placement of a paver array onto a subsurface with even and uniform spacing and orientation.

Circumstances exist that may necessitate the leveling and/or elevation of the established paver surface relative to the subsurface. For example, it may be necessary to position and/or level the paver surface above the subsurface in order to: facilitate drainage of the established surface when the component pavers are sensitive to water; provide for air circulation between the surface and the subsurface to prevent the buildup or mold or other residue; or to level the surface above an undesirably irregular or sloped undersurface. Accordingly, there is a need for an apparatus and related methods which facilitate the elevated and leveled placement of a paver array onto a subsurface with even and uniform spacing and orientation.

Various apparatus are known which facilitate the uniformly spaced and oriented placement of a paver array onto a subsurface. For example, U.S. Pat. Nos. D259,283 (issued May 19, 1981), 6,702,515 (issued Mar. 9, 2004), and D557,830 (issued Dec. 18, 2007) disclose apparatus featuring four uniformly dimensioned projections which are normal to the paver support surface whereby the projections divide the support surface into quadrants. See e.g., U.S. Pat. No. 6,702,515, FIG. 1. Referring to the same example, the disclosed apparatus, in operation: receive a corner of a square paver within each quadrant until the received pavers abut the projections whereby the received pavers are uniformly spaced; and, orient the pavers via rotating the entire apparatus, typically before the pavers are received, until the received pavers are aligned with the desired paver surface array. While such apparatus are suitable for spacing square pavers, the subject apparatus are not adequate since non-square pavers are often used when constructing a paver surface. Furthermore, shifting the entire apparatus to orient the paver array may be tedious. To improve upon the above mentioned limitations, apparatus are known which feature detachable projections whereby the orientation of the pavers may be manipulated via merely orienting the attachment of the detachable projections. See e.g., U.S. Pat. No. 6,625,951 (issued Sep. 30, 2003) and U.S. Pub. Pat. App. No. US2008/0222973 (published Sep. 18, 2008). However, these apparatus designs are still limited and may involve tedious attachment methods. Accordingly, there is still a need for an apparatus and related methods which facilitate the placement of a paver array onto a subsurface with even and uniform spacing and orientation.

Various apparatus are further known which facilitate the elevated placement of a paver array onto a subsurface. Referring once again to U.S. Pat. Nos. D259,283, and 6,702,515 for examples, the disclosed apparatus may elevate a paver surface via stacking a plurality of apparatus in vertical alignment before placing the paver array thereon. While such manner of paver surface elevation may be suitable for incremental increases in surface levels, stacking apparatus in the described manner is limiting of the ultimate height to which the stack may raise the surface since the base apparatus features the same dimensions as the top-most apparatus in the stack. Stacking apparatus to increase paver surface elevation is also limited because the exact adjustment of paver surface height depends on the thickness of the individual apparatus within the stack (i.e., exact adjustment of paver surface height requires multiple apparatus of different thickness or the shaving-off of apparatus thickness). To improve upon the above mentioned limitations, apparatus are known which feature: screw-jack mechanisms (see e.g., U.S. Pat. Nos. 3,223,415 (issued Dec. 14, 1965), 3,318,057 (issued May 9, 1967), 5,588,264 (issued Dec. 31, 1996), and 6,332,292 (issued Dec. 25, 2001); telescoping pedestal (see e.g., U.S. Pat. No. 4,570,397 (issued Feb. 18, 1986)); or central riser units which are measured to an exact desired height (see e.g., U.S. Pat. No. 6,520,471 (issued Feb. 18, 2003)). Screw-jack mechanisms are not completely satisfactory for raising the height of a paver surface since screw jack mechanisms are expensive to fabricate and the surface height cannot be increased beyond two-times the apparatus thickness without the addition of multiple components. See, e.g., U.S. Pat. No. 5,588,264, FIG. 4; see also US20080105172 (published May 8, 2008) wherein multiple component screw jacks are combined to increase overall height. A telescoping pedestal is unsatisfactory because it requires the manufacture of different sized levels or complex assembly methods (see e.g., U.S. Pat. No. 4,570,397 wherein a fill is added). Central riser designs are not adequate because accommodations cannot be made for inaccurate measurements or unanticipated changes in desired paver heights. Further, central riser designs are inadequate because such designs often require the existence of multiple distinct components for supporting the central riser, including base and cap members, which are expensive and tedious to fabricate due to the requirement of differing molds or other fabrication tools. Accordingly, there is a need for an apparatus and related methods which facilitate the elevated and leveled placement of a paver array onto a subsurface with even and uniform spacing and orientation.

Various apparatus are yet further known which facilitate the leveled placement of a paver array onto a sloping subsurface. For example, apparatus are known which feature: cooperating twist slope adjustment (see e.g., U.S. Pat. No. 6,332, 292); concave/convex interacting surfaces (see e.g., U.S. Pat. No. 3,318,057). Twist slope manipulation has not been suitable for compensating for a sloping subsurface because it only allows for slope adjustment at the paver support surface without permitting adjustment at the apparatus base. Concave/convex surface slope compensation is not adequate since the concave/convex surface interactions are relatively frictionless and unstable and therefore require additional components to keep the paver support surface from shifting orientation. See U.S. Pat. No. 3,318,057, FIG. 2, element 70; see also U.S. Pub. Pat. App. No. US2008/0222973, FIGS. 4 and 5, element 132, 134 and 72. Accordingly, there is a need for an apparatus and related methods which facilitate the elevated and leveled placement of a paver array onto a subsurface with even and uniform spacing and orientation.

Yet still, further drawbacks of the heretofore mentioned apparatus are the non-existence of a single component which may: (1) itself support a paver surface; (2) be stacked upon a like component to raise the height of a paver surface; (3) interact with a like component(s) to change the slope of the paver support surface relative to a sub surface; (4) cooperate with a like component to receive a riser therebetween whereby either of the like components may provide the paver support surface or the assembly base surface; (5) be assembled to multiple like components and a riser, wherein two of said like components define the assembly base and paver support surface, and whereby (i) the paver support surface may be elevated above a subsurface via a combination of the riser and stacked components and (ii) the slope of the elevated paver support surface relative to the subsurface may be manipulated at either the base of the assembly or at the paver support surface; (6) receive an attachment on its paver support surface for orienting and/or uniformly spacing adjacently positioned pavers provided to the component's paver support surface; and (7) receive an attachment(s) on its paver support surface for incrementally raising one or more pavers with respect to another paver to account for discrepancies in paver thickness. In other words, none of the heretofore known apparatus for elevating, leveling, and/or orienting a paver surface disclose a single component for accomplishing the referenced functionalities. On the contrary, apparatus heretofore known for establishing a paver surface require multiple and diverse components while yet only providing a fraction of the referenced functionalities. None of the heretofore known apparatus can adjust for slope, orient and space a paver, vertically support a paver surface while being composed of multiple like components for providing the recited functionalities. Accordingly, there is a need for an improved apparatus for establishing a paver surface without the deficiencies of apparatus which are presently known.

SUMMARY OF THE INVENTION

It is an object of the present application to disclose apparatus and related methods for facilitating the elevated and leveled placement of a paver array onto a subsurface with even and uniform spacing and orientation in a manner that alleviates the problems associated with apparatus heretofore known for the same purpose. In particular, it is an object of the present application to disclose a universal component that may: itself establish a paver support surface; be stacked for adjusting the height of a paver support surface; cooperate with a like component and a riser to establish a paver support surface above the riser and a base or the riser; interact with a like component to manipulate the slope of a paver support surface with respect to a subsurface; receive attachments for orienting and spacing adjacent pavers; and be assemble to multiple like components and a riser whereby all of the preceding may be accomplished in a single apparatus.

In one non-limiting example, the universal component may be collar having a generally truncated tubiform with, among other features: a first slanted step on the outer wall of the tubiform, a second slanted step on the inner wall of the tubiform, an established surface over one end of the tubiform (i.e., to close one end of the tubiform); and wherein the open end of the tubiform may be a receptacle for like components whereby the second slanted step may interface with the first step of a received collar or whereby the collar may receive a riser. The component itself may be an apparatus for supporting a paver surface. The component may interact with like components to assemble an apparatus for establishing an elevated and slope adjusted surface. Finally the apparatus may be assembled to multiple like components and a riser to produce an apparatus for elevating and leveling a paver surface. Further disclosed are exemplary methods of establishing a paver surface.

Other objectives and desires may become apparent to one of skill in the art after reading the below disclosure and viewing the associated figures.

BRIEF DESCRIPTION OF THE FIGURES

The manner in which these objectives and other desirable characteristics can be obtained is explained in the following description and attached figures in which:

FIG. 5D is a perspective view of the collar 1 and attachment 440 of FIG. 5A.

FIG. 9 is a contextual view of the apparatus 1 of FIG. 1 as used to construct a paver surface.

It is to be noted, however, that the appended figures illustrate only typical embodiments of this invention, and therefore, are not to be considered limiting of its scope, for the invention may admit to other equally effective embodiments that will be appreciated by those reasonably skilled in the relevant arts. Also, figures are not necessarily made to scale.

DETAILED DESCRIPTION OF PREFERRED EMBODIMENTS

In general, a preferred embodiment of the present application may be (1) a component of an apparatus for facilitating the elevated and leveled placement of a paver array onto a substrate or (2) an apparatus composed of such component. Suitably, the disclosed component itself may be an apparatus for supporting a paver surface or may interact with like components to assemble apparatus for establishing an elevated and slope adjusted surface. Yet still, the component suitably may be assembled to multiple like components and a riser to produce an apparatus for elevating and leveling a paver surface. The disclosed component may receive attachments for orienting and spacing an array of pavers to be supported by the component or an assemblage composed of the component. A further embodiment of the present disclosure may be methods of establishing a paver surface using the component or an assemblage composed by the component. The details of the preferable component are best disclosed by reference to FIGS. 1 through 9.

Figure 1A:
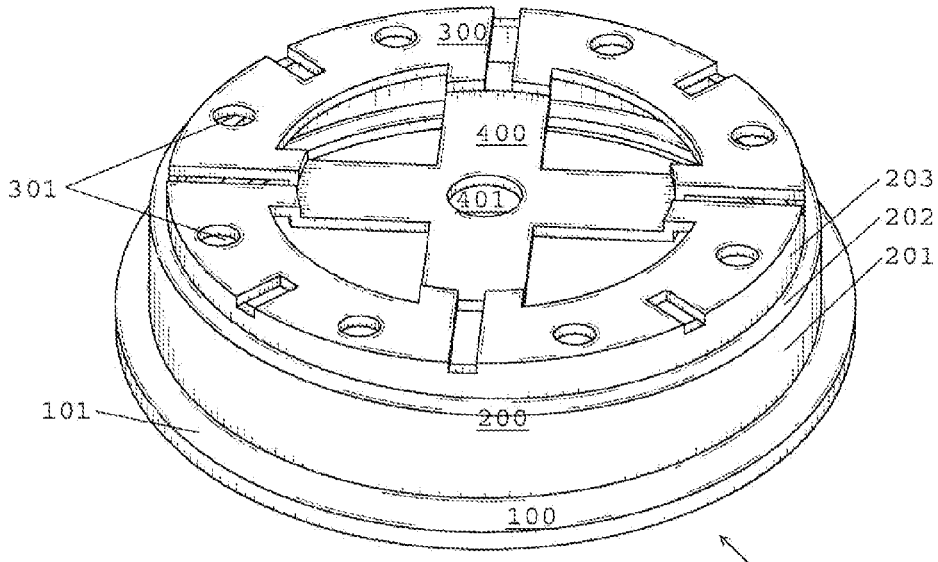
FIG. 1A a top perspective view of a collar 1.
Figure 1B:
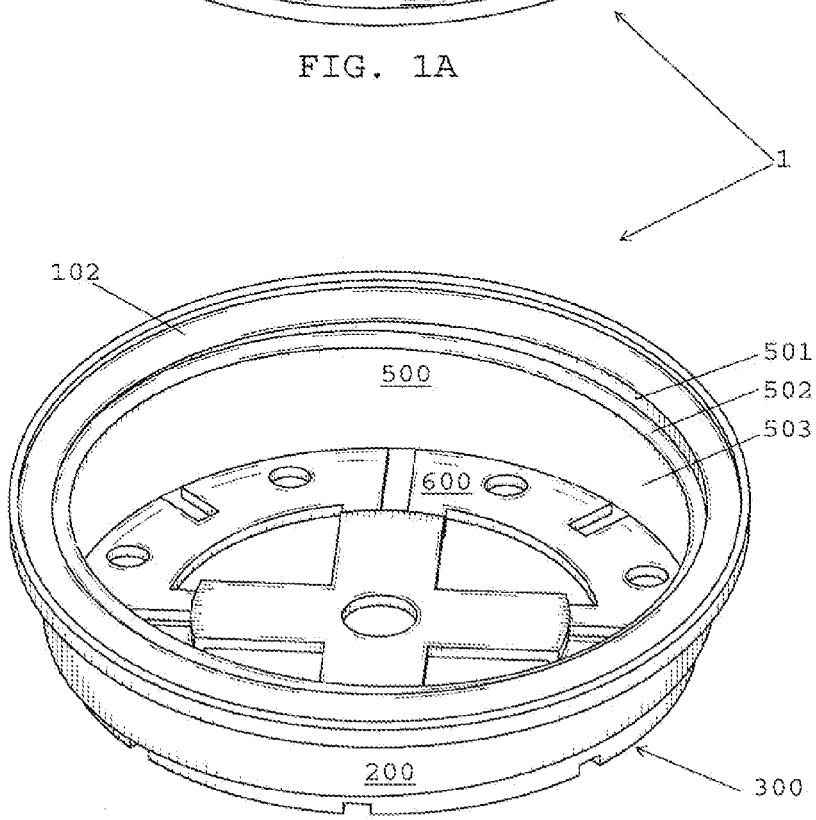
FIG. 1B is a bottom perspective view of the collar 1 of FIG. 1A
Figure 1D:
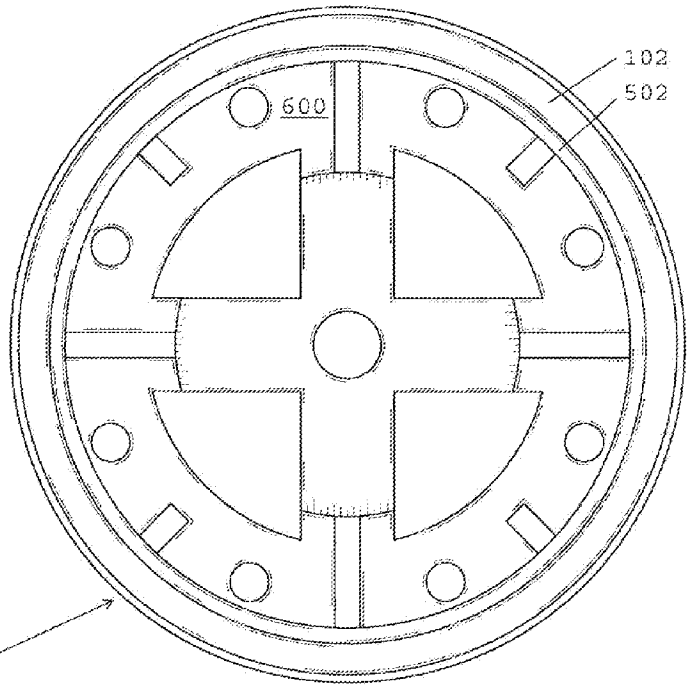
FIG. 1D is a bottom view of the collar 1 of FIG. 1A
Figure 1C:
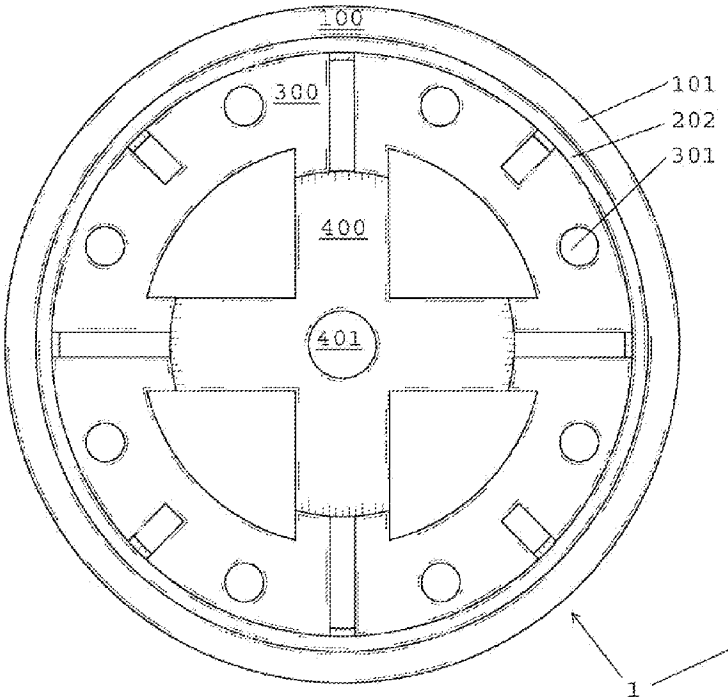
FIG. 1C is a top view of the collar 1 of FIG. 1A.
Figure 1E:
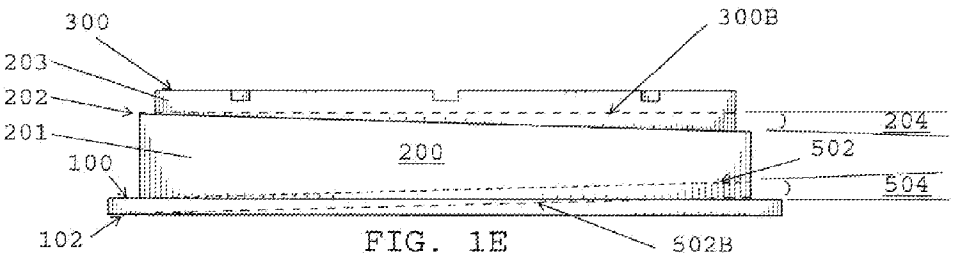
FIG. 1E is a side view of the collar 1 of FIG. 1A.

FIGS. 1A through 1E depict different view of a preferable embodiment of a component 1 of an apparatus for supporting a paver surface. Specifically, FIGS. 1A through 1E respectively depict a top perspective, bottom perspective, top plan, bottom plan, and side profile view of the component 1. As can be seen in the referenced drawings, the component 1 is generally a truncated tubiform and may comprise: a foot 100; an outer wall 200; an established surface 300 on at least a part of one end of the truncated tubiform; an attachment receptacle 400 on the surface 300; an inner wall 500 accessible at the unclosed end of the component's 1 truncated tubiform; and the underside 600 of the surface 300. FIGS. 1 through 1E suitably illustrate the above referenced components of the depicted apparatus 1.

The Foot 100.

The foot 100 is best depicted in FIGS. 1C through 1E. As seen in the cited figures, the foot is generally a rim or distal projection around the open end of the component's 1 truncated tubiform. As such, the foot 100 features an upper 101 (see FIG. 1C) and lower 102 (see FIG. 1D) surface. Operably, the foot 100, via the lower surface 102, may uprightly support the component 1 on a subsurface when such is positioned with its open end against the subsurface. Further, as discussed below, because the component 1 is configured to receive/retain items within its tubiform, the foot 100 may further define a gripping means for facilitating the receipt/retention and/or removal of such items.

It should be noted that, now, and throughout the application the terms "top" and "bottom" or "lower" and "upper", or any other orientation defining term should in no way be construed as limiting of the possible orientations of the component 1 (i.e., the component 1 may be positioned sideways, or in reversed vertical orientations even though the specification refers to a "top" and "bottom" parts).

Figure 3A:
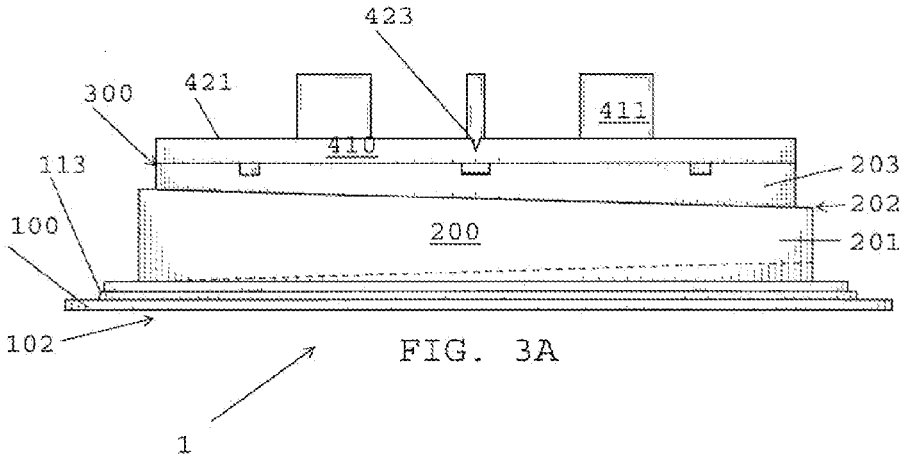
FIG. 3A is a side view of the collar 1 and attachment of FIG. 2A engaged with a buffer 110 and a shim 420.
Figure 3B:
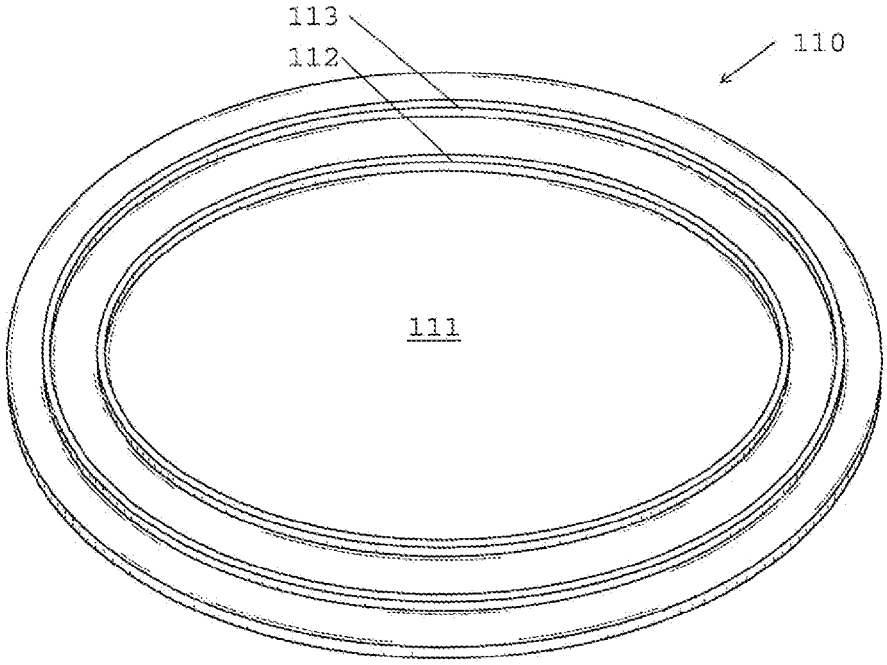
FIG. 3B is a perspective of the buffer 110 of FIG. 3A.
Figure 3C:
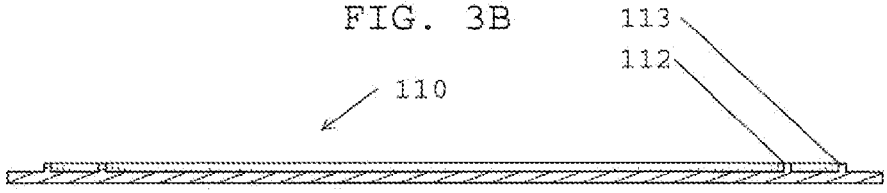
FIG. 3C is a side view of the buffer 110 of FIG. 3A.

Although the foot 100 is adapted to support the component 1 on a substrate, there may be instances where the substrate may be sensitive and require a larger footprint than that provided by the foot 100. For instance, the substrate may feature a waterproofing means that may be punctured by the weight of a paver on the component 1. In such a circumstance, the foot print of the foot 100 may be supplemented with a buffer, 110 as best depicted in FIGS. 3A, 3B, and 3C. FIG. 3A depicts a side view of the foot print of the foot 100 being supplemented with a buffer 100. The buffer 110 may generally be a disc with an upward projection of slightly larger plan than the plan of foot 100 whereby the foot 100 may be retained therein and where the disc of the buffer 100 distributes the footprint of the component 1 over a wider area. Other features of the buffer 100 will be set forth in greater detail below.

The Outer Wall 200.

The outer wall 200 is best depicted in FIGS. 1A and 1E. As seen in the figures, the outer wall 200 may suitably be the external portion of the component's tubiform. As such, the outer wall 200 generally extends between the foot 100 and the surface 300. As is further depicted, the outer wall 200 is suitably divided at a midpoint by a slanted step 202 into lower 201 and upper 203 sections. As seen in FIG. 1E, the upper portion 203 is offset from the lower portion 201 in terms of the component's external diameter to generally define the step 202 (see also FIG. 1C). As further seen in FIGS. 1E and 1A, the step 202 generally defines a plane that is oblique to the plane of the surface 300. The oblique angle is generally referenced by angle 204. Preferably, the slanted step 202 is disposed on the outer wall 200 at a location that is more toward the surface 300 end of the component 1, but the plane of the surface 300 should suitably be above the plane of the step 202 (i.e., the surface 300, in alternate embodiments, should preferably only be moved with respect to the step 202 to a location generally identified as surface 300B in FIG. 1E).

When a component is used in isolation, as discussed further below, the step 200 suitably serves only aesthetic purposes. However, when used in conjunction with a like component 1 (i.e., more than 1 component 1) the step 202 serves as a means for altering the slope of the surface 300 with respect to a subsurface. This functionality is discussed later below.

The Surface 300.

The surface 300 is best seen in FIGS. 1A, 1C, and 1E. Referring to these figures, the surface 300 generally encloses one end of the component's 1 tubiform to establish a load bearing surface. Operably, the surface 300 is adapted for receiving a paver whereby the paver is supported above a subsurface by the component 1. For example, a component 1 used in isolation may, after being placed foot 100 down on a subsurface, receive a paver or a portion thereof, on its surface 300 whereby the paver is supported above the subsurface.

The Attachment Receptacle 400.

Referring now to FIGS. 1A and 1C, the surface 300 features at least one mortise 301 and an attachment receptacle 400. The mortise 301 is generally an aperture or depression around the periphery of the surface 300. The attachment receptacle is generally a larger, central depression with an aperture 401. These components are generally for receiving attachments that either increase the relative height of the component 1, provide a means for orienting and/or spacing pavers provided to the surface 300, or both.

Figure 2A:
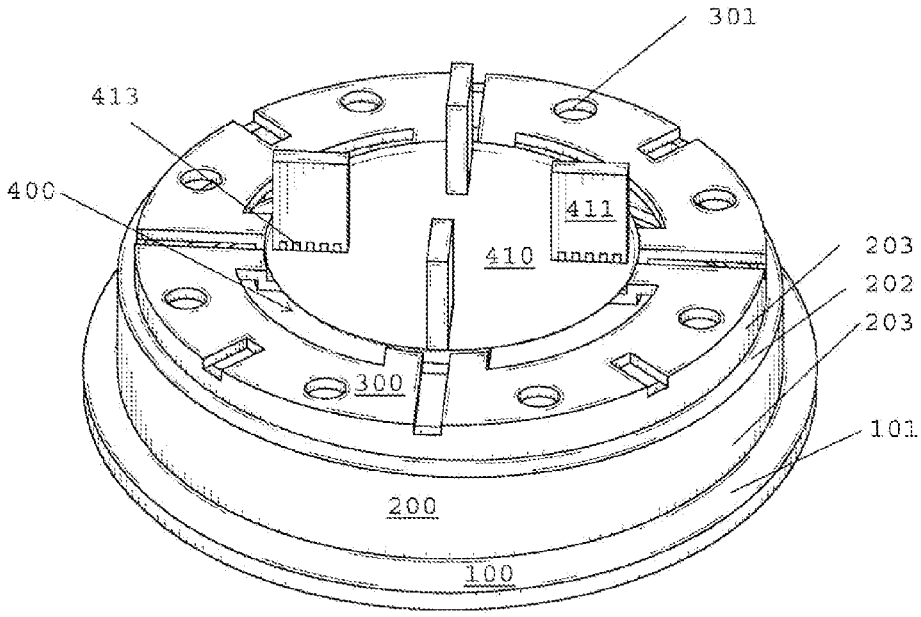
FIG. 2A is a top perspective view of the collar 1 of FIG. 1A retaining an attachment 410.
Figure 2B:
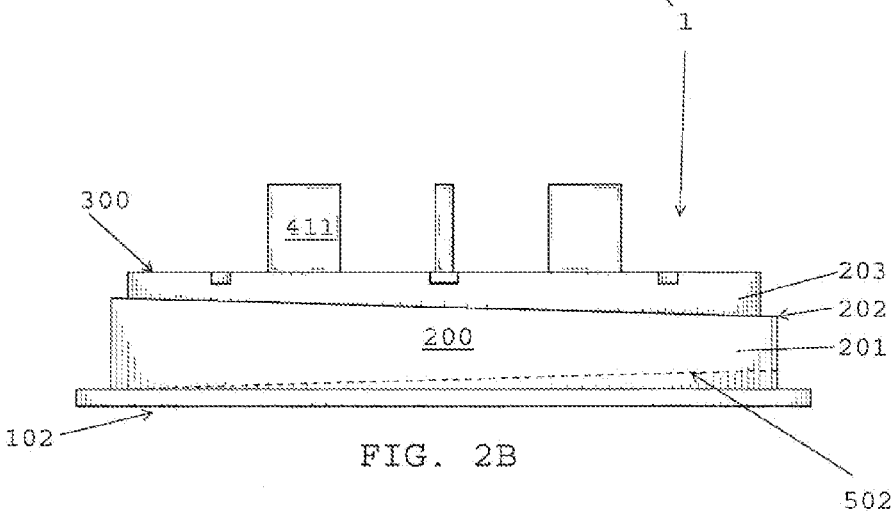
FIG. 2B is a side view of the collar 1 of FIG. 2A.
Figure 2D:
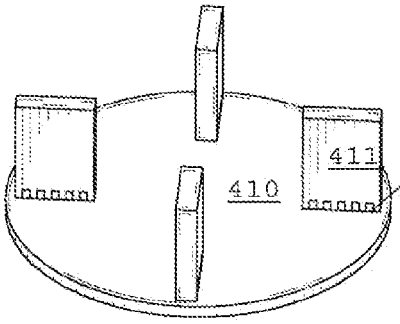
FIG. 2D is a perspective view of the attachment 410 retained by the collar of FIG. 2A.
Figure 2E:
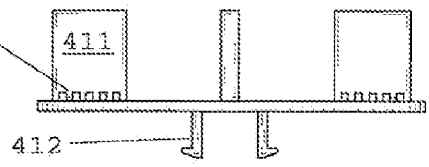
FIG. 2E is a side view of the attachment 410 of FIG. 2D.
Figure 2C:
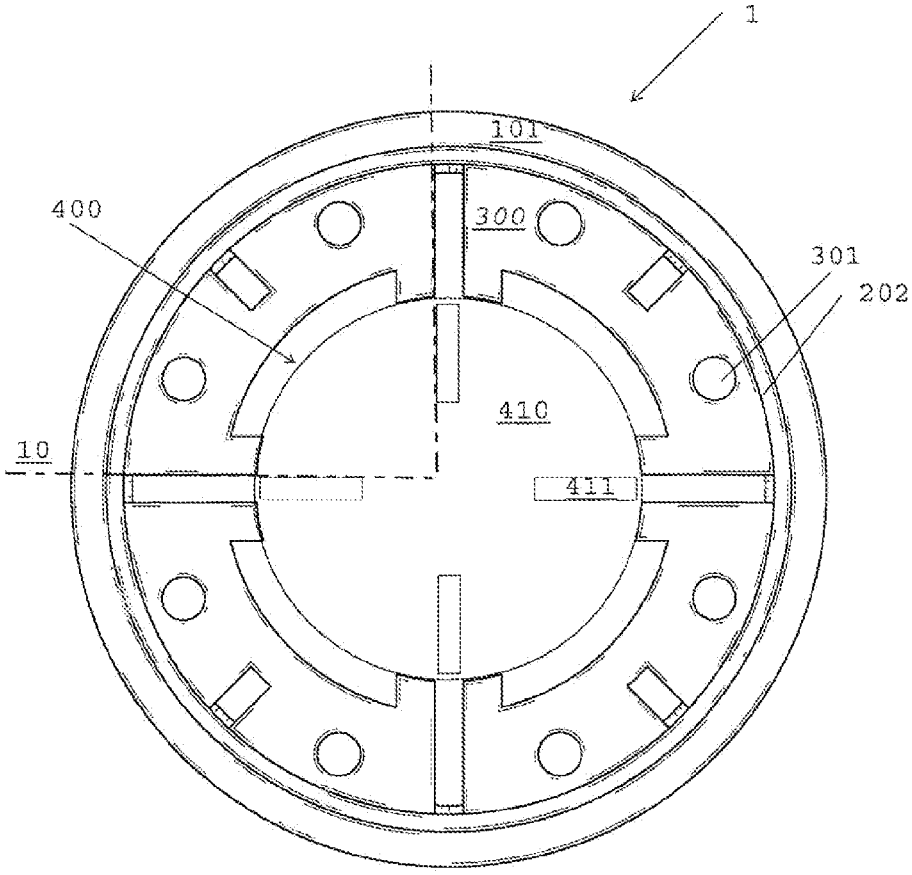
FIG. 2C is a top view of the collar 1 of FIG. 2A

FIGS. 2A through 2C depict the component 1 with an attachment 410 installed in the attachment receptacle. FIGS. 2D and 2E respectively illustrate perspective and side views of the installed attachment 410. Taken together these figures illustrate one aspect of the attachment receptacle. Referring to FIGS. 2D and E, the attachment is generally a disc adapted for placement within the attachment receptacle 400 whereby the disc and surface 300 establish a paver support plane. The attachment is preferably retained within the receptacle 400 via the locking means 412 deflectively inserting into the aperture 401 until its nibs snap into restrictive interface with the rim of the aperture 401 for restricting the removal of the attachment 410. As seen in FIGS. 2A through 2B the attachment features projections 411 that operate to divide the surface 300 into evenly spaced paver receptacles whereby pavers provided to the component 1 may be uniformly oriented and spaced. As depicted in FIG. 2C, for example, a paver 10 may be supported above a subsurface via: positioning a component 1, foot 100 down, on the subsurface; installing the attachment 410 on the surface 300 in the manner disclosed above, rotating the attachment 410 until the orientation of the projections 411 align with planned paver surface, and providing a corner of the paver 10 to the surface 300 whereby the sides of the paver abut the projections 411. See also FIG. 9 wherein the depicted pavers 10 are supported, spaced, and oriented by a component fitted with the attachment 410.

It should be noted that the dimensions of the projections 110 will vary depending on the desired paver spacing for the planned paver surface. It should further be noted that although the attachment is depicted with four projections 411 for dividing the surface into quadrants, the attachment may feature less or more projections to accommodate the orientation and spacing of non-square pavers. It should yet further be noted that the projections 411 feature perforations 413 whereby the projections 411 may be individually removed from the attachment. For instance, two of the four projections 411 may be removed from the attachment whereby the side of a square paver, instead of its corner, may be received by the surface 300.

It should be noted: although the locking means is depicted as a projection 412 with a nib for restrictive interaction with an aperture 401 rim, any number of suitable locking means may be used. Such locking means will be known by those of skill in the art, and may include, but should not be limited to, snaps, buttons, bolts, screw and nut mechanisms, and the like (e.g., a screw projecting downward for threaded entry into the aperture 117). It should also be noted that the paver receptacle attachment 410 may be fabricated of any number of materials that will be suitable for the perforated removal of the projections 411 from the disc 410. Such materials will be readily known to one of skill in the art, and may include, without being limited to: plastics, polymers, PVC, polypropylene, polyethylene; metals; woods; ceramics; composites and other synthetic or natural materials whether molded, extruded, stamped or otherwise fabricated. Finally, it should further be noted that, the dimensions of the attachment 410 will vary with the size of the paver to be retained by the 300. In particular, the height of the projections may vary depending on the thickness of a paver, e.g. in a range of about 0 to 20 inches.

Figure 3D:
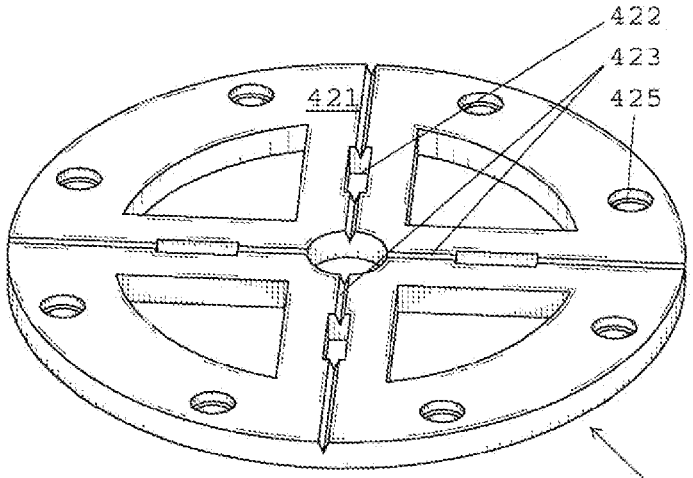
FIG. 3D is a perspective of the shim 420 of FIG. 3A.
Figure 3E:
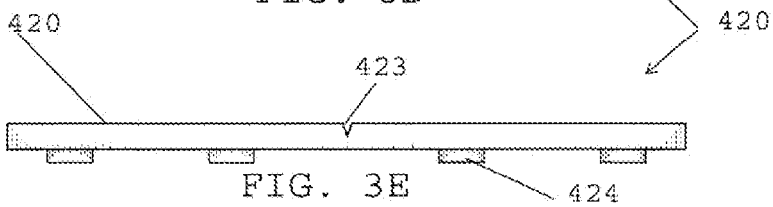
FIG. 3E is a side view of the shim 420 of FIG. 3A.

FIG. 3A depicts the component 1 with an attachment 410 installed in the attachment receptacle 400 and a shim 420 attached at the mortise 301 over the surface 300 and attachment 410. FIGS. 3D and 3E generally depict a perspective and side view of the shim 420 attachment. As can be seen in the figures, the shim 420 is generally a disc with: a supplemental paver support surface 421 that generally matches the plan of the component's 1 surface 300 plan; an aperture 422 for accommodating the projections 411 of the attachment 410 when such is disposed under the shim 420; at least one crease 423; at least one tenon 424 projecting from the underside of the disc; and, at least one mortise 425 on the surface 421.

Referring to FIGS. 3A, 2A, 2B, 3D, and 3E, a shim 420 may be provided to the component 1 in order to incrementally increase the effective height of its paver support surface. This function is particularly useful if the inherent support surface 300 is positioned, via the dimensions of the component 1, close to, but not quite at, the desired height for supporting a paver. Beginning with FIG. 2A, a component 1 having received an attachment 410 may be fitted with a shim whereby the support surface 421 becomes the paver support surface of the component 1 to shim 420 assembly, as depicted in FIG. 3A. To accomplish shim 420 installation, at least one of the tenons 425 of the shim 420 depicted in FIGS. 3D and 3E are provided to the mortise 301 on the component's 1 surface 300 after passing the projections 411 through the apertures 422 whereby the surface 300 interfaces with underside of the shim 420 as depicted in FIG. 2A. Operably, a shim 420 may be used to increase the effective height of a paver support surface relative to a subsurface. Multiple shims 420 may be retained by a component 1 via similarly coupling the tennons 424 of a first shim to the mortise 425 of a second shim 420.

Referring still to FIGS. 3A, 2A, 2B, 3D and 3E, a shim 420 may be provided to the component 1 in order to incrementally increase the effective height of one paver provided thereto with respect to the support surface of another paver simultaneously provided thereto. This function is particularly useful when the component 1 is to receive multiple pavers of differing thicknesses whereby the pavers may be nonetheless leveled. Beginning with FIG. 3E, a shim 420 features at least one groove or crease 423 whereby the shim 420 may be torn or otherwise cleaved into sections. Each section may be provided to a different part of the component's 1 surface in the manner disclosed above to increase the support surface of a particular paver rather than the entire surface 300 of the component 1.

Figure 4A:
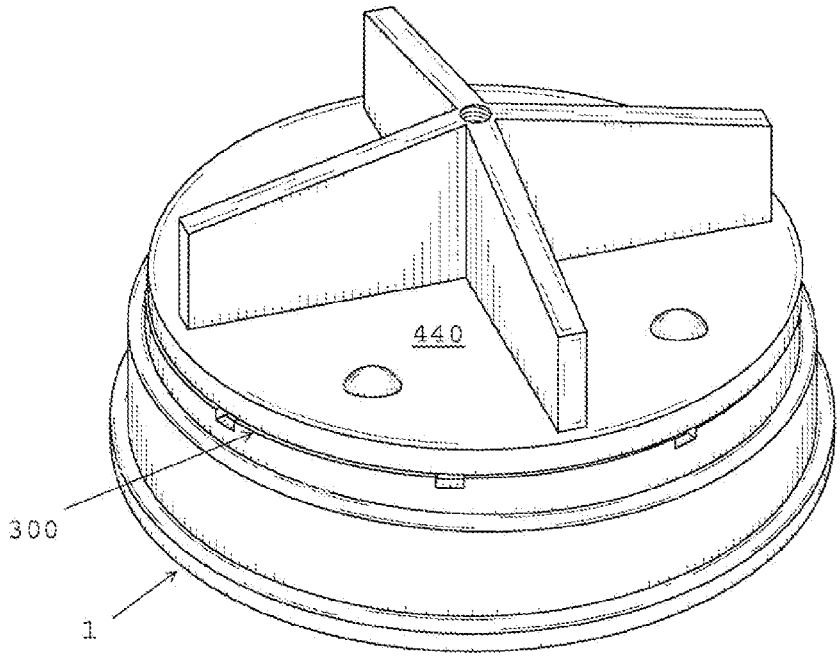
FIG. 4A is a perspective view of the collar 1 of FIG. 1A retaining another attachment 430
Figure 5A:
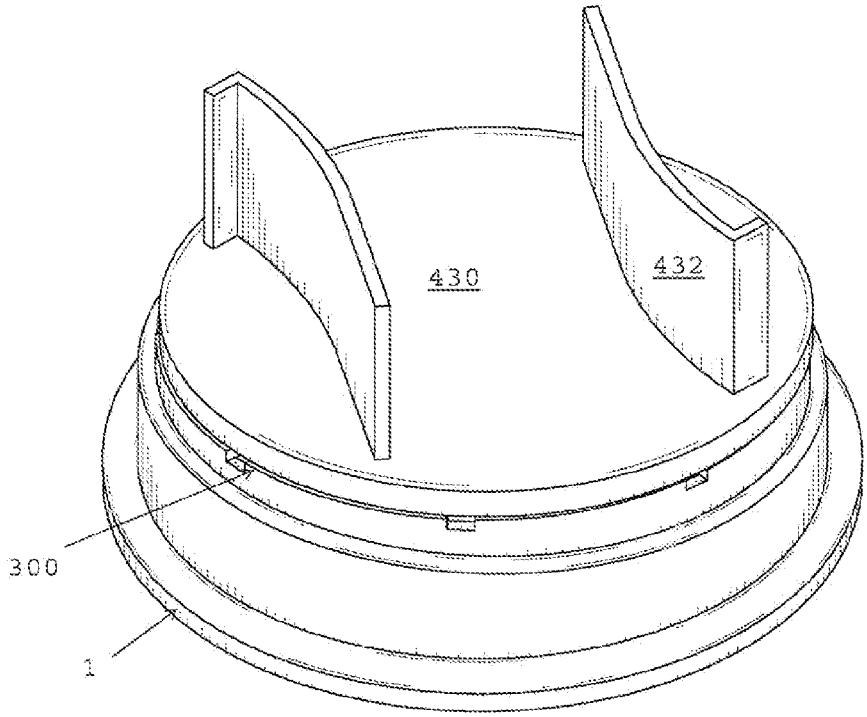
FIG. 5A is a perspective view of the collar 1 of FIG. 1A retaining yet another attachment 440.
Figure 5B:
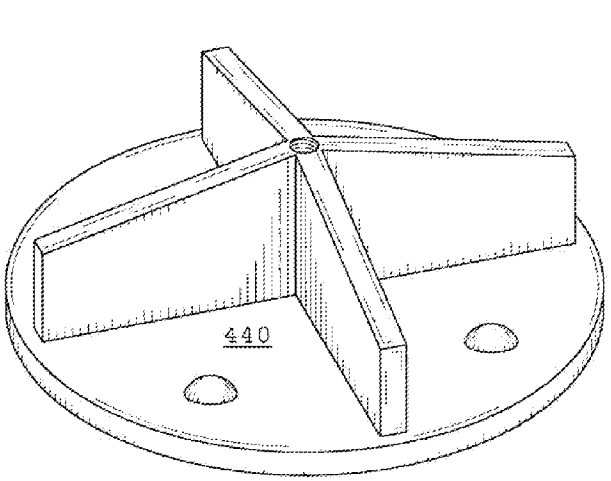
FIG. 5B is a perspective view of the attachment 440 of FIG. 5A.
Figure 5C:
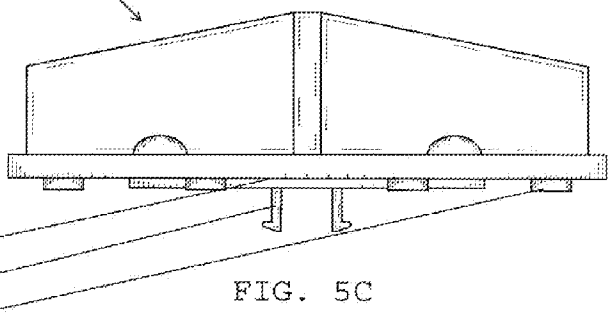
FIG. 5C is a side view of the attachment 440 of FIG. 5A.
Figure 4B:
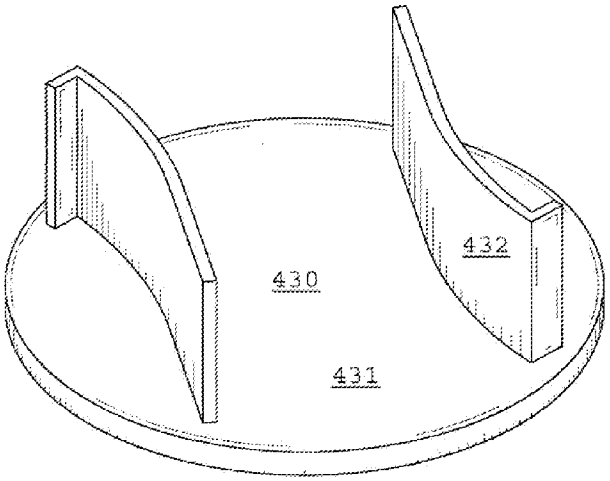
FIG. 4B is a perspective view of the attachment 430 of FIG. 4A.
Figure 4C:
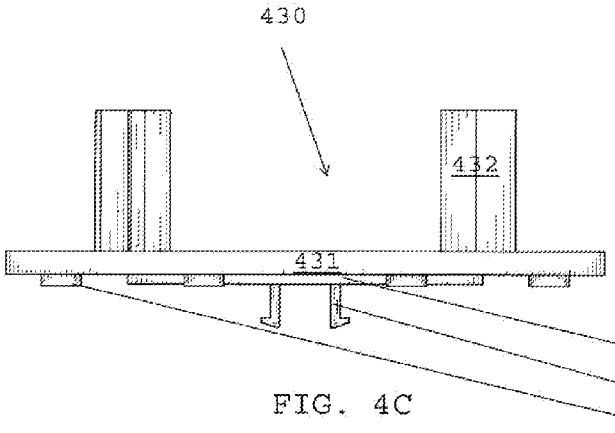
FIG. 4C is a side view of the attachment 430 of FIG. 4A.
Figure 5E:
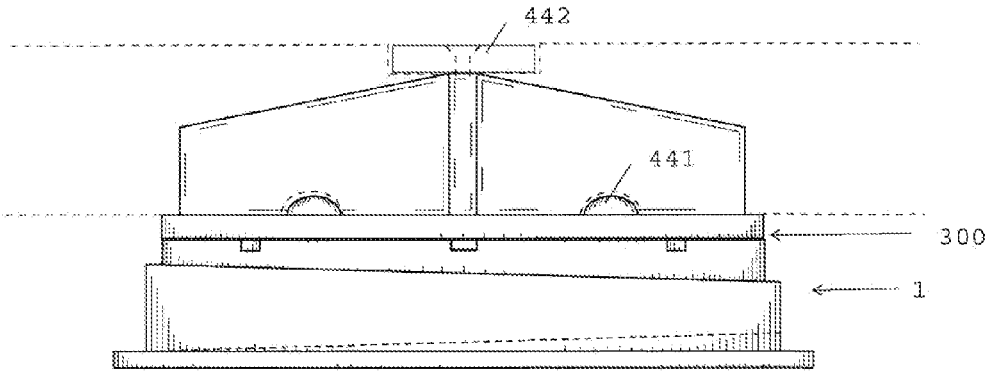
FIG. 5E is contextual side view of the collar and attachment 440 of FIG. 5A.
Figure 5E:
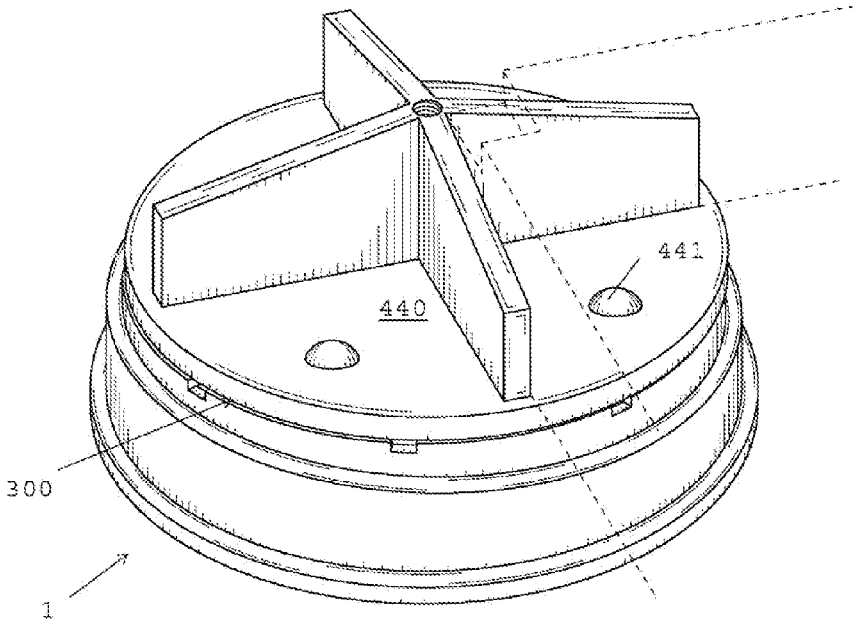

The attachment receptacle 400 and the mortise 301 on the surface 300 of component 1 may be used in conjunction to provide a surface to the component that is capable of receiving particular types of pavers or other types of supportable items. For this purpose, FIGS. 4A and 5A depict the component 1 with different attachments 430 and 440 installed on the component 1. FIGS. 4B and 4C respectively illustrate perspective and side views of the installed attachment 430 depicted in FIG. 4A. FIGS. 5B and 5C respectively illustrate perspective and side views of the installed attachment 430 depicted in FIG. 5A. While the attachments 430 and 440 feature differing upper-surfaces discussed in detail below, the undersurfaces, as seen by comparing FIGS. 4C with 5C, are similar whereby installation of the attachments 430 and 440 onto the component 1 is accomplished in the same manner. As seen in FIGS. 4C and 5C the attachments 430 and 440 suitably feature a projection 435 and locking means 436 on their underside that matches the general profile of the attachment 410 and its locking means 412 as depicted in FIG. 2E. As further seen in the stated figures, the attachments 430 and 440 suitably feature at least one tenon 437 that interacts with the mortise 301 on the surface 300 of the component 1 in a similar manner to that disclosed in connection with the shim 420 of FIG. 3E. Accordingly, either attachment 430 and 440 may be installed to a component 1 by simultaneously (1) directing the projection 435 and locking means 436 toward the attachment receptacle 400 and its aperture 401 as disclosed above in connection with attachment 410 and, (2) directing the tenon 437 towards a mortise 301 on the surface 300. By installing the attachments, a component 1 may have its paver support surface 300 replaced with the support surface of the attachment 430 and 440 as depicted in FIGS. 4A and 5A.

As alluded to above, a component may be adapted to receiving special or particular types of pavers or other items to be supported. Referring first to FIGS. 4A through 4C, a component may be adapted for the elevated support of a truss, i-beam, or like item via installing the attachment 430. As seen in the figure, the attachment features a support surface 431 and two curved projections 432. The projections are preferably curved whereby a beam or item to be supported may be slidably provided therebetween without edge-to-edge interaction between the item and the attachment 430. Suitably, a nail or screw may be placed through the projections 432 whereby the attachment 430 and item are affixed. When so associated, the item is supported in the same general manner as a paver. Referring now to FIGS. 5A through 5E, the a component 1 may be adapted for the elevated support of a special type of paver wherein the paver may be retained on the component via a mortise and tenon 441 connection on the underside of the paver and/or a screw clamp 442 on the upper side of the paver.

The Inner Wall 500.

The inner wall 500 is best viewed in FIGS. 1B, 1D, and 1E. As seen in the figures, the inner wall 500 may suitably be the internal portion of the component's 1 tubiform. As such, the inner wall 500 generally extends internally between the foot 100 and the underside 600 of the surface 300. As further depicted in the figures, the inner wall 500 is suitably divided at a midpoint by a slanted step 502 into lower 501 and upper 503 sections. As seen in FIGS. 1B and 1E, the upper portion 203 is offset from the lower portion 201 in terms of the component's 1 internal diameter to generally define the step 502 (see also FIG. 1D). As further seen in FIGS. 1E and 1B, the step 502 generally defines a plane that is oblique to the plane of the foot surface 102. The oblique angle has generally been identified by angle 504. Preferably, the slanted step 502 is disposed at a location on the inner wall 500 that is more toward the open end of the component 1, but the plane of the foot surface 102 should suitably be below the plane of the step (i.e., the step 502, in alternate embodiments, should preferably only be moved with respect to the foot 100 to a location generally identified as step 502B in FIG. 1E).

When a component 1 is used in isolation to support a paver, the step 200 suitably serves no functional purposes. However, when a component 1 is used in conjunction with a like component 1 (i.e., more than one component 1) the step 202 serves as a means for altering the slope of surface 300 with respect to a subsurface. This functionality is discussed later below.

Figure 6A:
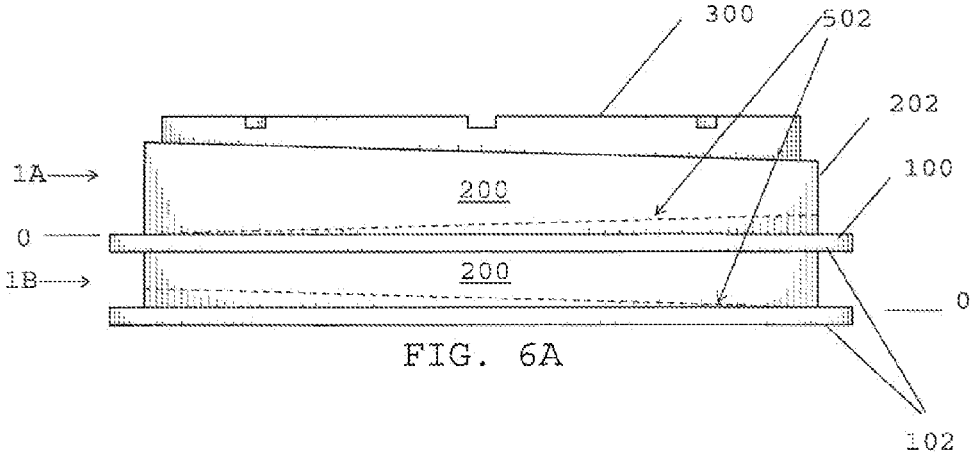
FIG. 6A is a side view of two stacked collars 1A and 1B.
Figure 6B:
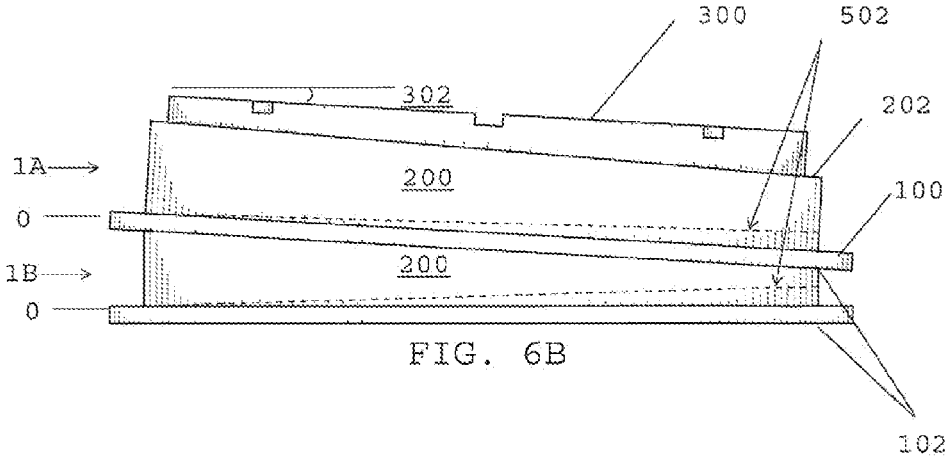
FIG. 6B is a side view of an alternate configuration of the stacked collars of FIG. 6A.

FIGS. 6A and 6B depict two like components 1A and 1B coupled in stacked configurations. The component 1, as best seen in FIG. 1B, features a receptacle which is generally defined by the inner wall 500 and is adapted to femininely receive the surface 300 end of a like component 1 until the inner step 502 of the receiving component (1A, FIG. 6A) interfaces with the external step 202 of the inserting component (1B, FIG. 6A). Referring still to FIGS. 6A and 6B, the orientation of the interface of the steps 202 and 502 may be manipulated to change the slope of the top surface 300 of the first collar 1A with respect to a lower surface 102 of the second collar 1B. The stated change in slope has been generally identified in FIG. 6B by the angle 302 between the upper surface 300 and the horizontal.

Referring first to FIG. 6A, the first and second components 1A and 1B are oriented with respect to one another whereby the angles 204 and 504 are approximately alternate interior angles with respect to the step interface, the surface 300 of the first component 1A, and the lower surface 102 of the second component 1B. (i.e., the surface 300 of the first component 1A and the lower surface 102 of the second collar are parallel and the concentric axes of the components 1A and 1B are aligned). The FIG. 6B configuration, can generally be obtained by identifying an origin point 0 on the foot 100 of both components 1A and 1B and subsequently stacking the components whereby the origin 0 on the first component 1A diametrically opposite (one-hundred and eighty degrees around the axis of the insertive component 1B) to the origin 0 of the second component 1B. Further, the angle 302 in this configuration is suitably zero degrees whereby the surface 300 of the receiving component 1A is parallel with the lower surface 102 of the inserting component 1B.

Referring now to FIG. 6B, the receptive and insertive components 1A and 1B are oriented with respect to one another whereby the angles 204 and 504 of the insertive and receptive components 1A and 1B compound (i.e., have the same vortex point and share a common reference plane). The above described second configuration typically occurs when the origin point 0 on the first component 1A is aligned with the origin point 0 on the second component 1B as depicted in FIG. 5B. Further, the angle 302 in this configuration is suitably the sum of angle 204 and 504 degrees whereby the surface 300 or the receiving component 1 is oblique to the lower surface 102 of the inserting component 1B.

Preferably, rotating the first component 1A around the axis of the second component 1B along the interface of steps 202 and 502 and between the above-identified FIG. 6A and FIG. 6B configurations (i.e., rotating the origin of component 1A with respect to the axis of component 1B) will vary the size of the angle 302 between the upper surface 300 of the first component 1A and the relative horizontal. Suitably, a maximum degree (sum of angles 204 and 504) for the angle 302 will be obtained in the identified second configuration, a zero degree will be obtained as identified in the FIG. 6A configuration, and an intermediate angle may be elected via positioning the origin of component 1A in between zero or one hundred eighty degrees relative to the origin and axis of component 1B. It should be noted: although the external wall 200 of the insertive component 1B may have a tendency to interact with the inner wall 500 of the receptive component 1A whenever the configuration of the stacked collars 110 is changed from the FIG. 6A configuration, such an interaction may be avoided or mitigated by: (1) reducing the angles 204 and 504 to a smaller degree; (2) outwardly tapering the lower portion 501 of the inner wall 500 (but not the upper portion 502); and (3) lowering the surface 300 to 300B with respect to step 202 while lowering the step 502 to step 502B as depicted in FIG. 1E. Referring again to FIGS. 6A, 6B and 1E, in the present embodiment the angles 204 and 504 are approximately 1 degree whereby the angle 302 may vary from between 0 and two degrees. Subject thereto, the angles 204 and 504 need not be limited to 1 degree, but rather it is preferable that the angles 204 and 504 be in a range of about 0 to 5 degrees whereby the angle 150 may be selected to between a range of about 0 and 10 degrees depending on the circumstances.

Referring once again to FIGS. 6A and 6B, an assembly of stacked components may function as an apparatus for supporting a paver above a substrate. Still referring to FIGS. 6A and 6B, the stacked components 1A and 1B may generally support a paver in a similar manner as a single component 1 disclosed above in connection with the earlier figures. Specifically, (1) the foot 100 of the insertive component 1B may be provided to a subsurface for supporting the stacked components 1A and 1B thereto, and (2) the receptive component 1A may generally receive and support pavers, including via attachments 410, 420, 430, and 440 in the same manner as a single component 1 acting alone as discussed above. However, unlike a single component 1 acting alone, a stack of components 1A and 1B can compensate for an undesirable slope on the undersurface via manipulating the step 202 and 502 interface, and correspondingly the slope (angle 302, FIG. 6B) of the surface 300 of the receptive component 1A, whereby a paver is supported by the surface 300 in a level manner with respect to the subsurface. Manipulation of the step 202 and 502 interface of receptive and insertive components 1A and 1B may generally be accomplished as described above in connection with FIGS. 6A and 6B. Furthermore, greater variation of slope can be accomplished via stacking more than two components 1 and manipulating all the resulting step 202 and 502 interface of any receptive and insertive components 1.

Figure 7:
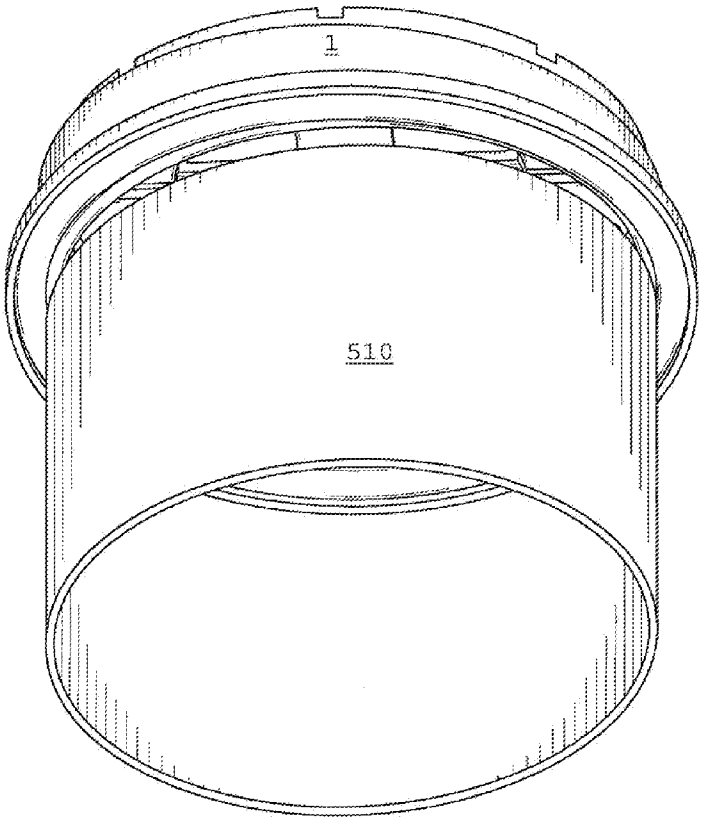
FIG. 7 is a perspective view of a riser 120 coupling to a collar of FIG. 1A.

FIG. 7 depicts a riser 510 being inserted into the tubiform of a component 1. As seen in the FIGS. 7 and 1B, the riser 510 is preferably a long body generally of the same plan as the perimeter of the inner wall 500 around the upper portion 503. Referring still to FIGS. 7 and 1B, a received riser 510 is suitably retained by the component 1 against the inner wall 500 and against the underside 600 of the upper surface 300. Thus retained, the component may act as a surface for supporting a paver above the riser 510 or a base for uprightly supporting the riser 500. These functionalities are discussed further below.

Operably, a riser 510 may be received by the component 1 for increasing the vertical distance between a substrate and a paver supporting surface 300 as generally taught by U.S. Pat. No. 6,520,471 (issued Feb. 18, 2003). As discussed in great detail in that patent, the axial length of the riser 510 may be adjusted to control the height of the apparatus 1. In a preferred embodiment, the pedestal is a section of one-inch PVC pipe (note that the term "one-inch" is misdescriptive as the actual external diameter is not one-inch), but, as with the other components, the riser 510 may be of any material or dimensions suitable for supporting the required paver load and/or paver dimensions.

Figure 8A:
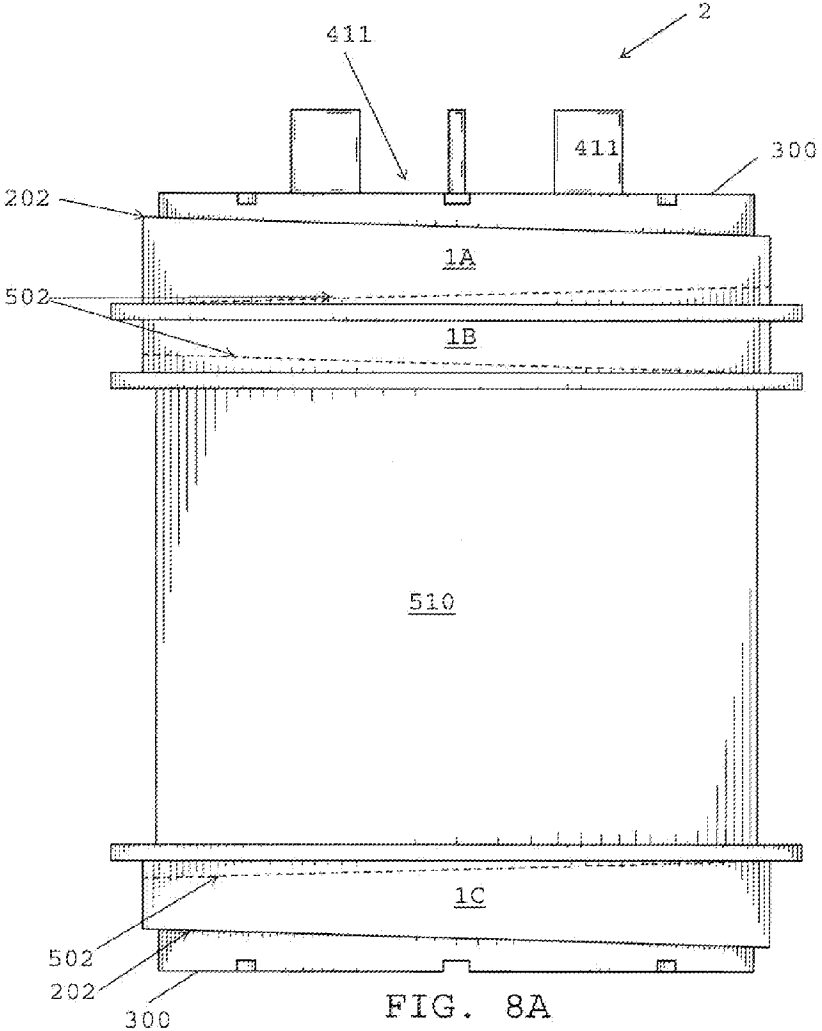
FIG. 8A is a side view of an apparatus 2 for facilitating the elevated and leveled placement of a paver array onto a substrate with even and uniform spacing and orientation composed of the collars 1 of FIG. 1A.
Figure 8B:
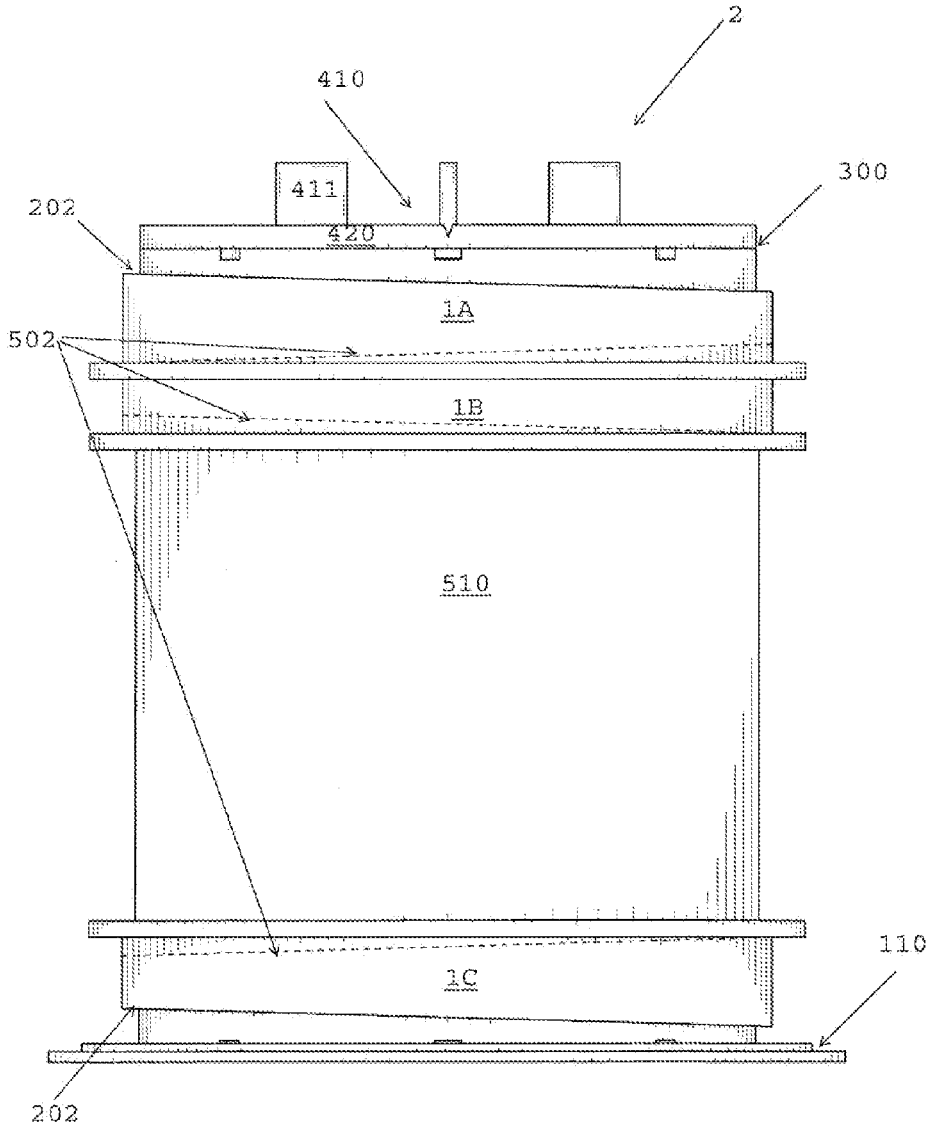
FIG. 8B is an alternate embodiment of the apparatus 2 of FIG. 8A featuring additional components.

FIGS. 8A and 8B depict an apparatus 2 for supporting a paver that is constructed of a plurality of components 1A, 1B, and 1C and a riser 510. As can be seen at least one of the components 1A may operate as a paver support surface 300 and may interact with an insertive component 1B as a means for adjusting the slope of the surface 300 relative to a substrate. In other words, components operate in the manner disclosed above in connection with the earlier figures in terms of its paver supporting and slope compensating functions despite being positioned atop the riser 510. As can further be viewed in the figures, the component 1C may further act as the base of the riser 510. More specifically, the surface 300 of the component 1C may be positioned against the substrate whereby the apparatus is provided a larger foot print and, therefore, a more stable base. It should be noted: although the component 1C at the base of the apparatus is depicted as a single component, the base of the apparatus 2 too may feature stacked components to serve a slope compensating function in closer proximity to the subsurface.

Although the component 1C surface 300 is adapted to support the apparatus 2 on a substrate, there may be instances where the substrate may be sensitive and require a larger footprint than that provided by the surface 300. For instance, the substrate may feature a waterproofing means that may be punctured by the weight of a paver on the apparatus 2. In such a circumstance, the foot print of the surface 300 may be supplemented with a buffer, 110 as best depicted in FIGS. 8B, 3B, and 3C. FIG. 8B depicts a side view of the apparatus' 2 base 1C, being supplemented with a buffer 100. The buffer 110 may generally be a disc with an upward projection 112 of slightly larger plan than the plan of surface 300 whereby the surface 300 may be retained therein and where the disc of the buffer 100 distributes the footprint of the apparatus over a wider area than provided by the surface 300 of base 1C.

Figure 8C:
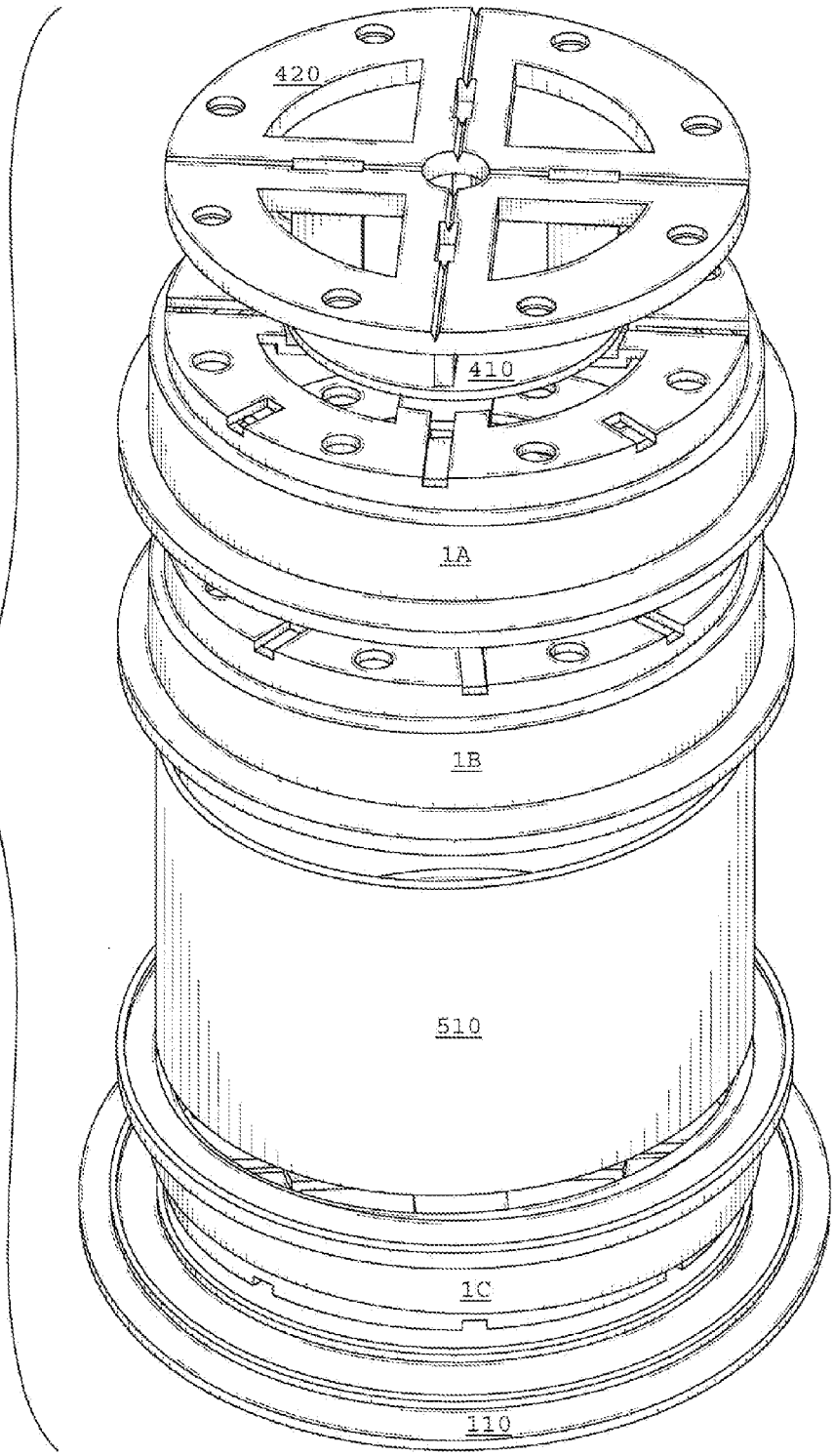
FIG. 8C is an exploded perspective view of the apparatus 2 of FIG. 8B.
Figure 8C:
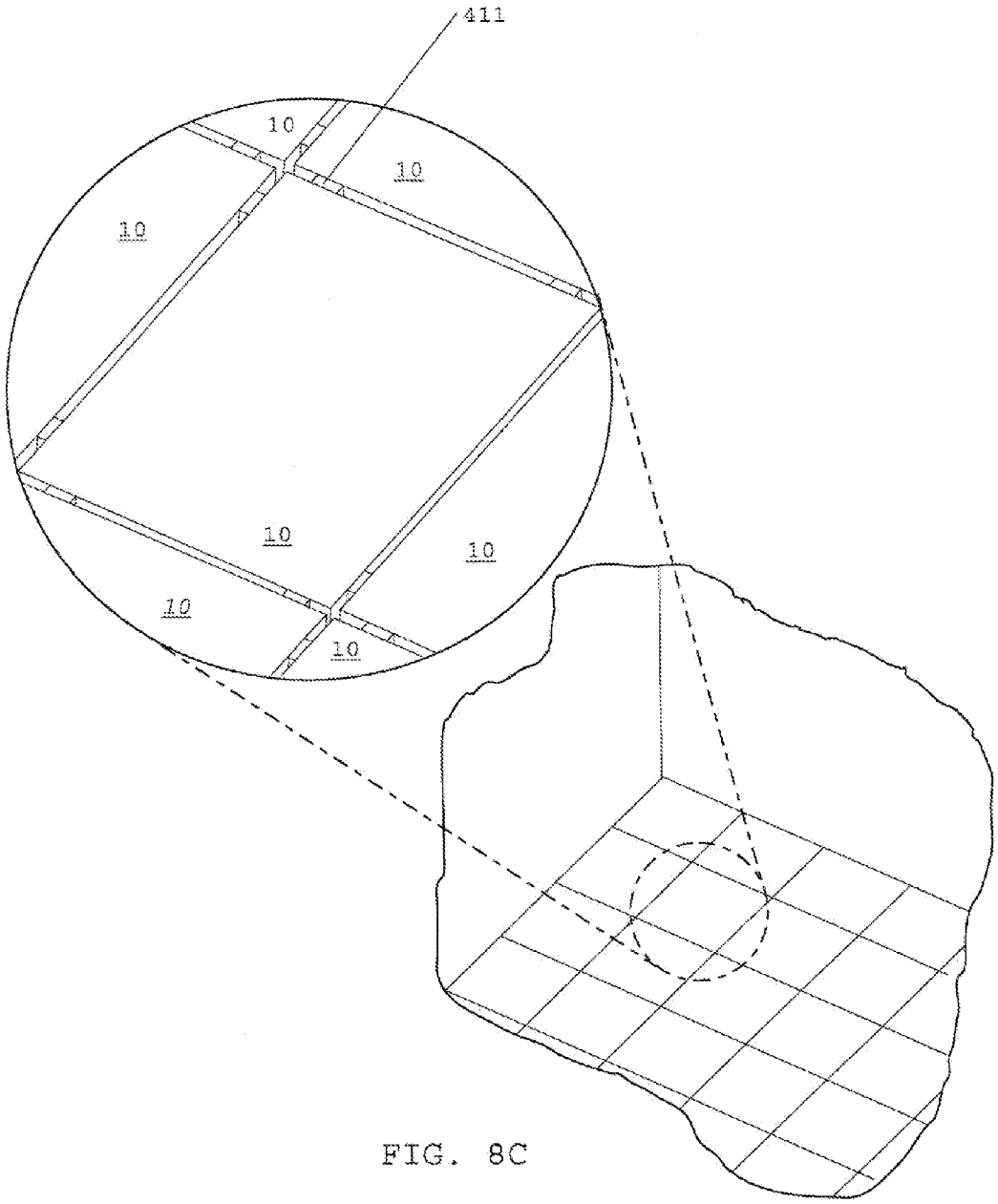

FIG. 8C is an exploded view of FIG. 8B and illustrates the assembly of a preferable apparatus 2 composed of a plurality of components 1A, 1B, and 1C. As seen in the figure, the apparatus 2 may be assembled by: (1) providing a buffer 110 to a substrate; directing the a component 1C to engage the buffer as disclosed above in the preceding paragraph; insertably engaging the riser 510 with the component 1C in the manner disclosed in connection with FIG. 7; insertably engaging the riser 510 with another component 1B in the same manner; engaging the component 1B with yet another component 1A in the manner disclosed in connection with FIGS. 6A and 6B; and, optionally providing attachments to the support surface 300 of the uppermost component 1A in the manner stated above.

The component 1, being or composing a paver load bearing apparatus, should preferably be fashioned out of materials that are capable of supporting the weight of a paver. As the weight of a paver may vary from extraordinarily heavy to very light, the materials which may be acceptable for fabricating the component 1 will typically vary according to the applicable paver to be supported thereon the apparatus 2. Depending on the circumstance, such materials will be readily known to one of skill in the art, and may include, without being limited to: plastics, polymers, PVC, polypropylene, polyethylene; metals; woods; ceramics; composites and other synthetic or natural materials whether molded, extruded, stamped or otherwise fabricated.

Similarly, the component 1 being or composing a paver load bearing apparatus 1 should preferably be dimensioned to a size that renders the apparatus 1 capable of retaining a paver. As the size of a paver may vary from big to little, the physical dimensions of the component 1 will typically vary according to the applicable paver to be supported thereon the apparatus. Depending on the circumstance, such dimensions will be readily known to one of skill in the art, and may include, without being limited to a component 1 having an diameter spanning its tubiform of 1.36 inches. The dependence of the size and dimensions of the component 1 apply equally well to the other aspects and parts of this disclosure including attachments and risers.

An apparatus comprised of an above disclosed component may be used to compensate for variations in the slope of the undersurface with regard to the leveling of a paver surface. For example, the method may comprise the following steps: obtaining a plurality of components comprising a structure having an inner slant step and an outer slant step, said inner slant step configured to interface with the outer slant step of a like component, an outer slant step, and support surface; insertably coupling two of said components whereby the inner slant step of the receptive component interfaces with the outer slant step of the insertive component; manipulating the orientation of the insertive component with respect to the receptive component along the step interface; and, providing a paver to the support surface. The exemplary method may be altered wherein a step of placing the support surface on the subsurface replaces the step of providing a paver to the support surface. The exemplary method may further be altered wherein the structure is tubiform. Yet another alteration of the exemplary method may be wherein the structure is capable of receiving and retaining a riser or wherein the insertive component is receptively coupled to a riser. Yet further still, the exemplary method may be adapted wherein the component further comprises an attachment receptacle and wherein the attachment receptacle rotatably retains an attachment comprising a disk with perforated projections for orienting and spacing pavers provided thereto.

The present application presents an improvement over the prior art components for apparatus that facilitate the elevated and leveled placement of pavers on a subsurface. In particular, unlike the prior art and among other things, the component may itself be a paver support, provide a means for subsurface slope compensation, receive a pedestal or riser, and receive paver orienting and spacing attachments. Furthermore, apparatus composed of the disclosed component are an advancement over apparatus for supporting a leveled and elevated paver surface since such may be composed of a more than one like components 1 and a riser 510. Other prior art apparatus for supporting pavers do not provide the same functionalities and are not as minimally assembled or fabricated. Additional benefits of the disclosed component and structures composed thereof will become readily apparent to one of ordinary skill in the art after reading this specification.

It should be noted that FIGS. 1 through 9 and the associated description are of illustrative importance only. In other words, the depiction and descriptions of the present invention should not be construed as limiting of the subject matter in this application. Additional modifications may become apparent to one skilled in the art after reading this disclosure.

I claim:

1. A component of an apparatus for supporting a paver over a subsurface comprising:

a structure having an inner slant step and an outer slant step, said inner slant step configured to interface with the outer slant step of a like component;

a paver support surface thereon said structure;

an attachment receptacle on said paver support surface; and, wherein the attachment receptacle rotatably retains an attachment comprising a disk with perforated projections for orienting and spacing pavers provided thereto.

2. The component of claim 1 further comprising a foot around the structure.

3. The component of claim 1 wherein the structure is generally tubiform.

4. The component of claim 3 wherein the structure is capable of receiving and retaining a riser.

5. The component of claim 4 receptively coupled to a riser.

6. The component of claim 5 insertably coupled to a like component whereby the outer slant step of the insertive component interfaces with the inner slant step of the receptive component.

7. The component of claim 1 insertably coupled to a like component whereby the outer slant step of the insertive component interfaces with the inner slant step of the receptive component.

8. An apparatus for supporting a paver surface comprising:

at least two components, each comprising a structure having a support surface, an inner slant step and an outer slant step;

said inner slant step of one of said at least two components configured to interface with the outer slant step of another of said at least two components wherein said one and another of said at least two components are insertably coupled whereby the inner slant step of the one of said at least two components is interfaced with the outer slant step of the another of said at least two components;

a riser coupled to the another of said at least two components;

an attachment receptacle on said support surface; and, wherein the attachment receptacle rotatably retains an attachment comprising a disk with perforated protections for orienting and spacing pavers provided thereto.

9. The apparatus of claim 8 wherein the components further comprise a foot.

10. The apparatus of claim 8 wherein the structure is generally tubiform.

* * * * *